United States Patent [19]

Lutze et al.

[11] 4,393,947

[45] Jul. 19, 1983

[54] SOUND ATTENUATING ROCK DRILL SHANK

[75] Inventors: Uwe Lutze, Munich; Dieter Scholz, Unterpfaffenhofen; Ernst Brennsteiner, Munich, all of Fed. Rep. of Germany

[73] Assignee: Hilti Aktiengesellschaft, Schaan, Liechtenstein

[21] Appl. No.: 324,522

[22] Filed: Nov. 24, 1981

[30] Foreign Application Priority Data

Nov. 27, 1980 [DE] Fed. Rep. of Germany ..... 3044775

[51] Int. Cl.[3] ..... E21B 17/22

[52] U.S. Cl. ..... 175/323; 173/DIG. 2

[58] Field of Search ..... 175/219, 323, 394, 409; 408/143, 226, 241; 173/139, 162 R, DIG. 2

[56] References Cited

U.S. PATENT DOCUMENTS

| | | | |
|---|---|---|---|
| 3,422,913 | 1/1969 | Young | 175/394 X |
| 4,016,944 | 4/1977 | Wohlfeld | 175/394 X |
| 4,266,830 | 5/1981 | Retka et al. | 175/394 X |
| 4,290,653 | 9/1981 | Lagowski | 299/87 |

FOREIGN PATENT DOCUMENTS 2543578 4/1977 Fed. Rep. of Germany .

*Primary Examiner*—Ernest R. Purser
*Assistant Examiner*—Joseph Falk
*Attorney, Agent, or Firm*—Toren, McGeady and Stanger

[57] ABSTRACT

A rock drill includes a drill shank with a boring head at one end and laterally enclosed for at least a portion of its length by a tubular shell. A helix extends around the outside of the tubular shell for carrying borings away from the boring head. Supporting members formed of a sound attenuating material are located between the helix and the other parts of the rock drill.

8 Claims, 2 Drawing Figures

SOUND ATTENUATING ROCK DRILL SHANK

SUMMARY OF THE INVENTION

The present invention is directed to a rock drill including a drill shank, a boring head at one end of the shank, and a helix laterally surrounding the shank and serving to carry borings away from the boring head. A tubular shell is positioned between the drill shank and the helix. The tubular shell is spaced from the drill shank by centering means formed of a highly polymerized material. The tubular shell supports the helix.

In relatively large diameter drills with a relatively narrow feed shoulder on the helix, a large cross section of the drill shank is necessary. Such a drill construction results in a very bulky drill shank which consumes a significant amount of the percussion energy and, as a consequence, that portion of the energy is no longer available for drilling. To reduce the transverse cross-sectional size of the drill shank, it is known to provide a tubular shell between the drill shank and the helix with the shell spaced radially outwardly from the shank by centering rings formed of a highly polymerized material and with the helix supported on the tubular shell. Accordingly, the helix is supported and centered by the tubular shell. A significant disadvantage; of this arrangement is that the tubular shell is vibrated by the helix or the drill shank and such vibrations develop a high sound output from the shell.

There is another known rock drill in which sound damping is provided by surrounding the drill shank with a covering of a sound-attenuating material, such as rubber, a plastics material or the like. The helix is supported on the covering. For a relatively large diameter drill, this construction has the already mentioned disadvantage of a large drill shank diameter and, therefore, considerable bulk.

The primary object of the present invention is to provide a rock drill with a tubular shell surrounding the drill shank so that the drill has limited sound projection.

In accordance with the present invention, supporting elements of sound-attenuating material are arranged between the helix and the other parts of the rock drill.

Supporting elements of this type prevent, to a great extent, the transfer of sound conducted through solids between the helix and the boring head, drill shank and tubular shell. Further, such supporting elements prevent the tendency of the helix to perform with a natural vibrating effect. The supporting elements may be formed of a sound attenuating material such as rubber, plastics material or the like, and a urethane polymer is particularly suitable.

In most rock drills, the helix is in engagement with the boring head so that the parts rotate together. To achieve as complete as possible a sound neutralization, it is advantageous that supporting elements are arranged between the helix and the boring head. The supporting elements may be connected to the boring head or to the helix.

A significant part of the vibrations which produce noise are generated by the drill shank while transmitting percussive force. To prevent the transmission of such vibrations to the helix, it is advantageous if the supporting elements are located between the helix and the drill shank. Supporting elements can be constructed as centering rings spacing the tubular shell from the drill shank.

Another form of sound transmission occurs between the tubular shell and the helix. To eliminate the tendency of these parts to cause vibrations in one another, it is advantageous to position supporting elements between the helix and the tubular shell. Such supporting elements can be connected to the tubular shell or to the helix. It is also possible to arrange such supporting elements as independent third parts.

To achieve effective sound damping, it is helpful if the supporting elements are constructed as a covering at least partially surrounding the tubular shell. The covering may be formed as a separate element and then pushed over the tubular shell. Another possibility is to apply the covering directly to the tubular shell, such as by spraying.

For optimum sound damping, it is advantageous to enclose the tubular shell over its entire length with the covering. In this way the tubular shell does not have any surfaces from which the sound can be reflected without a damping effect. A covering over the full length of the tubular shell can be easily achieved by dipping, spraying or rolling. Further, as mentioned previously, it is possible to pull or shrink-fit a prefabricated covering tube over the tubular shell.

For effective production it is advantageous to form the covering and the centering rings as an integral member made of a sound-attenuating material. In this way, the centering rings are connected with the tubular shell so they cannot slide or be displaced.

To prevent the generation of noise-causing vibrations in the hollow space between the drill shank and the tubular shell, it is preferable to provide a lining of a sound-attenuating material between the shell and the shank. Such a lining may be connected to the tubular shell or to the drill shank. The radial dimension of such a lining should be such that it does not contact both parts at the same time thus forming a sound bridge between them.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
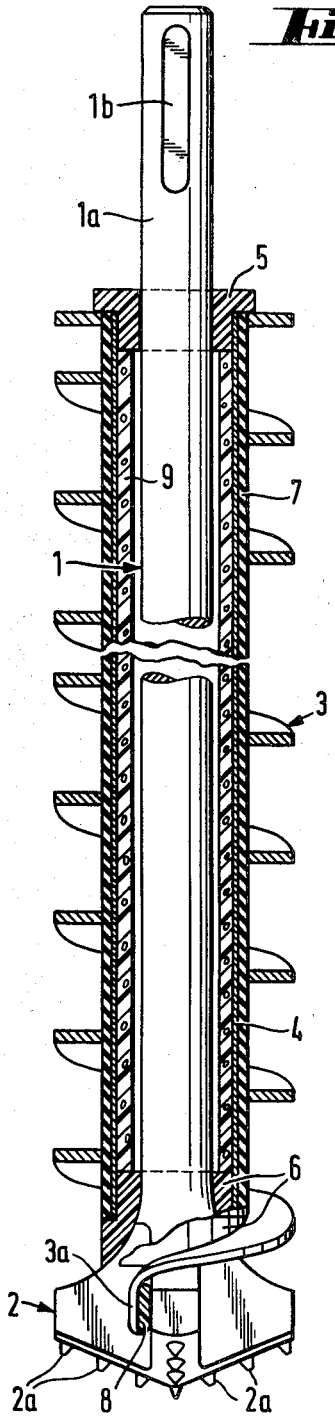
FIG. 1 is an elevational view, partly in section, of a rock drill embodying the present invention and including a tubular shell having an outside covering and an inside lining.

In FIG. 1 a rock drill is shown including an axially elongated drill shank 1 with a boring head 2 formed on one end. The boring head 2 is formed as a unit with the drill shank 1. Drill shank 1, at its opposite end from the boring head, has an end portion 1*a* with an axially extending slot 1*b* for affording rotary engagement with a drilling tool. The boring head 2 has cutting edges with outwardly extending projections 2*a*.

A helix 3 encircles the drill shank 1 from the boring head 2 for a major portion of the length of the shank terminating adjacent the trailing end shank portion 1*a*. Helix 3 centers the rock drill during operation and also serves to carry borings out of the hole being drilled. A tubular shell 4, coextensive with the drill shank 1, is positioned between the shank and the helix 3. A centering ring 5, 6 is located at each end of the tubular shell 4 and centers the shell on the drill shank. The centering rings 5, 6 are formed of a sound-attenuating material.

A covering 7 of a sound-attenuating material is provided around the outside of the tubular shell 4 and separates the shell from the helix 3. Covering 7 contacts both the outside of the tubular shell 4 and the helix 3 and serves both as a support for the helix and as a barrier preventing transmission of vibrations between the helix 3 and the tubular shell 4. The sound-attenuating material forming the centering rings 5, 6 and the covering 7 can be rubber, plastics material or the like.

The end of the helix 3 at the boring head 2 forms a driving lug 3*a* connected for rotary engagement with the boring head by a plate-shaped supporting element 8 for affording as complete as possible a sound neutralization between the drill shank 1 and the helix 3. Supporting element 8 is also a sound-attenuating material and may be rubber, plastics material or the like.

To prevent noise generation in the hollow annular space between the shaft 1 and the tubular shell 4, a lining 9 of a sound-attenuating material is located between the shank and the shell. As illustrated, lining 9 is attached to the inside surface of the tubular shell 4. The lining, however, could be connected to the outside surface of the drill shank 1. The lining should be separated from one of the drill shank 1 or tubular shell 4 to avoid forming a sound bridge between the two members. An aerated plastics material, such as Styropor, mineral wool or the like can be used for the lining 9.

Figure 2:
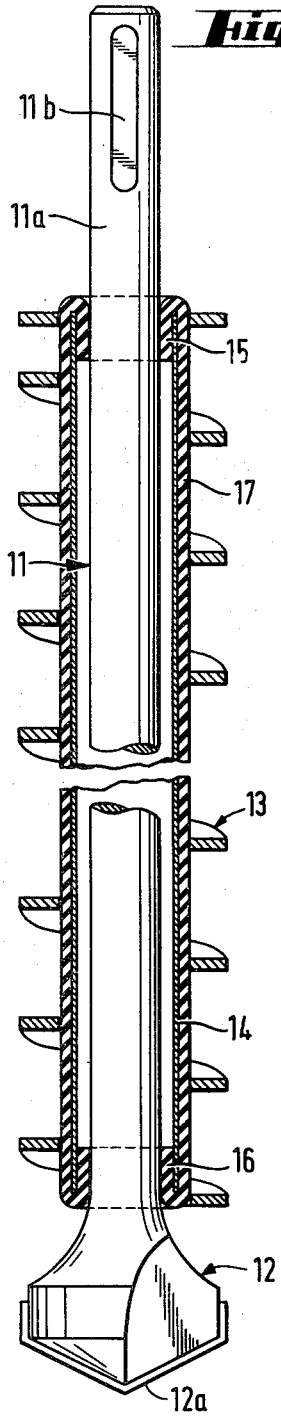
FIG. 2 is a view similar to FIG. 1 showing another embodiment of a rock drill incorporating the present invention with a covering around the tubular shell which also forms centering rings.

Another embodiment of the rock drill incorporating the present invention is shown in FIG. 2 and includes a drill shank 11 with a boring head 12 at the leading end of the shank. Trailing end shank portion 11*a* has an axially extending slot 11*b* for rotary engagement with a drilling tool. Boring head 12 has a plate-shaped cutting edge 12*a*. A helix 13 extends around the shank from adjacent the boring head 12 to the trailing end shank portion 11*a*. A tubular shell 14 is positioned between the drill shank 11 and the helix 13. Centering rings 15, 16 center the opposite ends of the tubular shell 14 about the drill shank 11. In this embodiment, centering rings 15, 16 are formed integrally with an axially extending covering 17 made of a sound-attenuating material which encloses the outside surface of the tubular shell 14. Covering 17 supports the helix 13 and prevents the transmission of vibrations between the helix and the tubular shell. In addition, natural vibrations of the tubular shell are prevented to a great extent by this arrangement. The covering 17 is formed of vibration-attenuating materials, such as rubber, plastics material and the like. The covering 17 can be applied on the outside surface of the tubular shell by spraying, shrink-fitting or vulcanization.

While specific embodiments of the invention have been shown and described in detail to illustrate the application of the inventive principles, it will be understood that the invention may be embodied otherwise without departing from such principles.

We claim:

1. Rock drill comprising an axially elongated drill shank, a boring head at one end of said drill shank, a helix extending around and in the axial direction of said shank for carrying borings away from said boring head, said helix spaced radially outwardly from said shank, an axially extending tubular shell coextensive for the axial length thereof with said drill shank and located between said shank and said helix, means formed of a highly polymerized material for spacing said tubular shell radially outwardly from said drill shank, said helix is supported on said tubular shell, wherein the improvement comprises means located between said helix and said drill shank for providing a sound-attenuating effect and said sound-attenuating means comprises first a support element, located between and in contact with said helix and said tubular shell and serving both as a support for said helix and as a barrier preventing the transmission of vibrations between said helix and said tubular shell.

2. Rock drill, as set forth in claim 1, wherein said sound-attenuating means comprises a second support element located in contact with and between said helix and said boring head.

3. Rock drill, as set forth in claim 1, wherein said sound-attenuating means comprises a third support element located between said helix and said drill shank.

4. Rock drill, as set forth in claim 1, wherein said first support element comprises an annular covering laterally enclosing at least an axially extending portion of said tubular shell.

5. Rock drill, as set forth in claim 4, wherein said covering encloses the outside surface of said tubular shell over the full axial length thereof.

6. Rock drill, as set forth in claims 4 or 5, wherein said covering and said means for spacing said tubular shell from said drill shank are formed from a single piece of sound-attenuating material.

7. Rock drill, as set forth in claim 1, wherein said sound-attenuating means includes an annular lining of sound-attenuating material located between the inside surface of said tubular shell and said drill shank.

8. Rock drill, as set forth in claim 7, wherein said lining is in contact with one of said drill shank and tubular shell and is spaced from the other one.

* * * * *